US007204608B2

(12) United States Patent
Beeman et al.

(10) Patent No.: US 7,204,608 B2
(45) Date of Patent: Apr. 17, 2007

(54) VARIABLE COLOR LANDSCAPE LIGHTING

(75) Inventors: Randy Beeman, Sarasota, FL (US); David M. Chism, Bradenton, FL (US); Darrell L. Fernald, Jr., Bradenton, FL (US)

(73) Assignee: Beeman Holdings Inc., Sarasota, FL (US)

( * ) Notice: Subject to any disclaimer, the term of this patent is extended or adjusted under 35 U.S.C. 154(b) by 449 days.

(21) Appl. No.: 10/763,682

(22) Filed: Jan. 23, 2004

(65) Prior Publication Data

US 2004/0257006 A1 Dec. 23, 2004

(51) Int. Cl.
*F21V 1/00* (2006.01)

(52) U.S. Cl. ..... 362/233; 362/362

(58) Field of Classification Search ..... 362/233, 362/362

See application file for complete search history.

(56) References Cited

U.S. PATENT DOCUMENTS

| | | | |
|---|---|---|---|
| 6,166,496 | A | 12/2000 | Lys et al. |
| 6,357,892 | B1 | 3/2002 | Beadle |
| 6,608,614 | B1 | 8/2003 | Johnson |
| 2002/0001192 | A1 | 1/2002 | Suchiro et al. |
| 2003/0161110 | A1 | 8/2003 | Spasevski et al. |

*Primary Examiner*—David Vu
(74) *Attorney, Agent, or Firm*—Fish & Richardson P.C.; Richard P. Ferrara

(57) ABSTRACT

A system of variable color landscape lights illuminated by multiple light emitting diode chips provides the user a controllable spectral output. In its various configurations, the electronic control system allows a selection of various spectral light radiation. The color output of the light emitting diode chips is electronically controlled and can be changed by means of a push button switch, radio frequency control, infrared control, signals impressed on line voltages, and other control system means.

26 Claims, 10 Drawing Sheets

VARIABLE COLOR LANDSCAPE LIGHTING

CROSS-REFERENCE TO RELATED APPLICATIONS

This application claims the benefit of priority from U.S. Patent Application entitled "Electronically Controlled, Variable Color Landscape Lighting Using Multiple Light Emitting Diode Chips on a Printed Circuit Support Member," filed Oct. 23, 2002, application Ser. No. 10/278,699, now abandoned, which is incorporated herein by reference in its entirety.

BACKGROUND

The present disclosure relates generally to lighting systems and more particularly to landscape lighting systems.

Color enhancement of trees, planting beds, buildings, signage, driveways, sidewalks, landscaped paths, and the like may be desired for its aesthetically pleasing decorative effects and visual interest, as well as for seasonal accent. Red, white and blue colors may be favored for July $4^{th}$ celebrations, red and green for end of the year holidays, pastels for Easter, and orange for Halloween. Also, as a replacement for glaring white light, when a choice is offered, muted colors may be preferred and equally effective in many safety related navigation-assisting applications around commercial and residential structures. Incandescent, fluorescent and T-1¾ LED assemblies are currently used in the illumination of landscape features, walkways, driveways, signage and buildings for decorative and safety enhancement purposes. Should color accent be desired, color control for white incandescent and fluorescent lights can be accomplished by bulb exchange or through the use of colored filters. Changing colors would require additional bulb and filter exchange. Such color control is labor intensive and requires the storage and handling of numerous spare/replacement parts. Using single or multiple light emitting diodes (LED) assemblies, color change can be achieved by means of multiple switches that control multiple colored LED assemblies.

BRIEF SUMMARY OF THE DISCLOSURE

The methods and techniques disclose an electronically controlled landscape lighting system that uses multiple light emitting diode chips to provide rapid color change.

The systems and techniques described here may provide one or more of the following advantages. The light emitting diode chips can provide for long life of the illumination system when compared to incandescent systems. The light emitting diode sources have lower energy consumption than standard incandescent lighting systems with equivalent light output. An electronic controller may change the radiated color without changing bulbs or lenses. The lighting system can provide nearly instantaneous electronically controlled color-changing capability.

The details of one or more implementations of the invention are set forth in the accompanying drawings and the description below. Other features and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

This disclosure is for landscape lighting whereby electronically-controlled multiple light emitting diode chips 13 are mounted on a support member and controlled in such a manner to permit the selection of colors at will. Various input voltages, selected by the user (not shown), power the disclosure in its various configurations. Although the accompanying illustrations show the multiple light emitting diode chips 13 being mounted in housing configurations standard to the lighting industry such as pagoda-style (FIGS. 1–4), spotlight (FIGS. 5–8), and floodlight (FIGS. 9–11), the housing configuration used is not critical and any type of landscape lighting fixture or other lighting fixture configuration that is made weather-resistant can be used. Color selection in the emitted light can be performed by various means, including a local push button, radio frequency controllers, signals impressed on the line voltages, infrared controllers, and/or any combination thereof.

Figure 1:
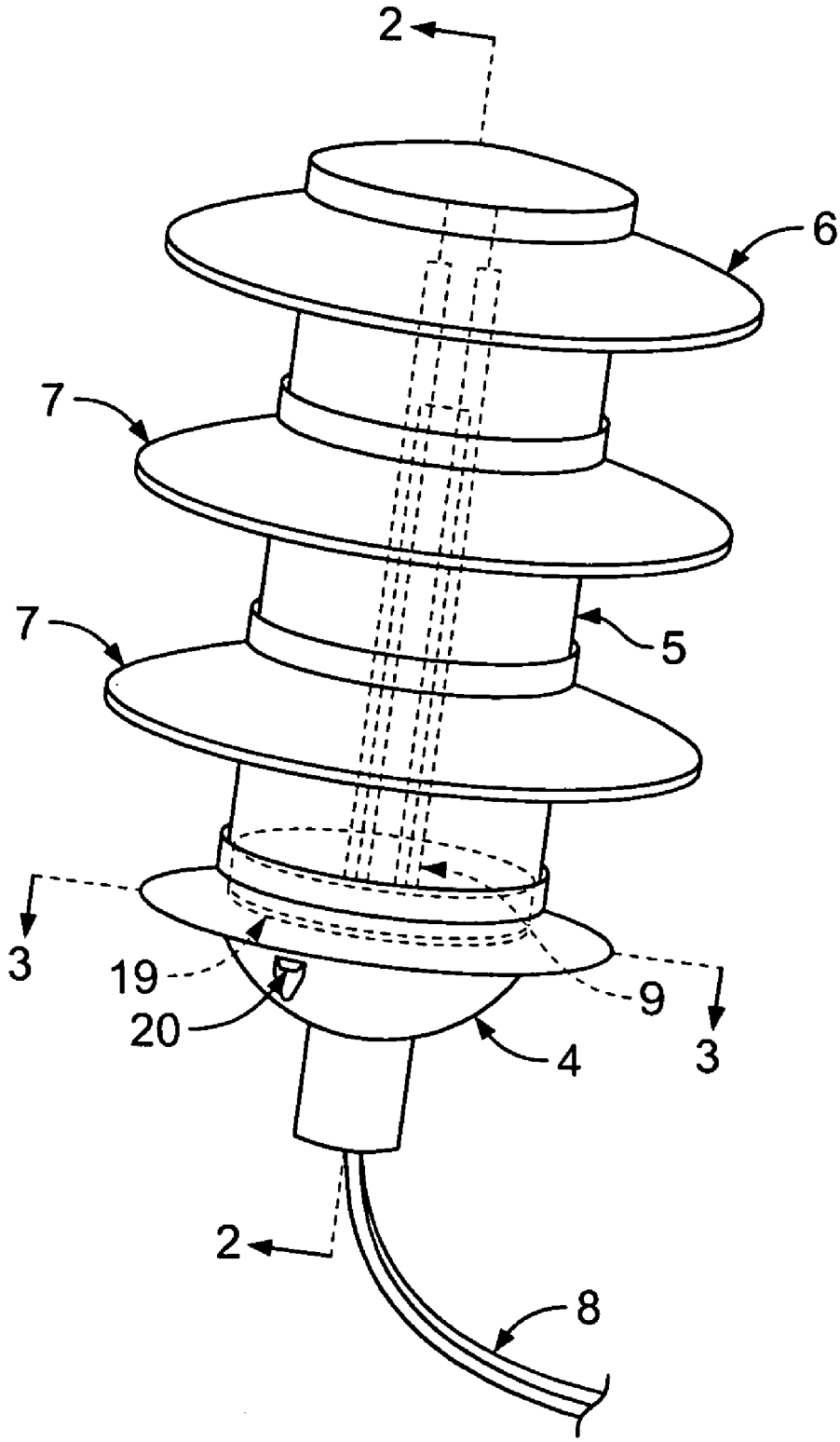
FIG. 1 is a perspective view of the present disclosure in one possible use configuration.
Figure 2:
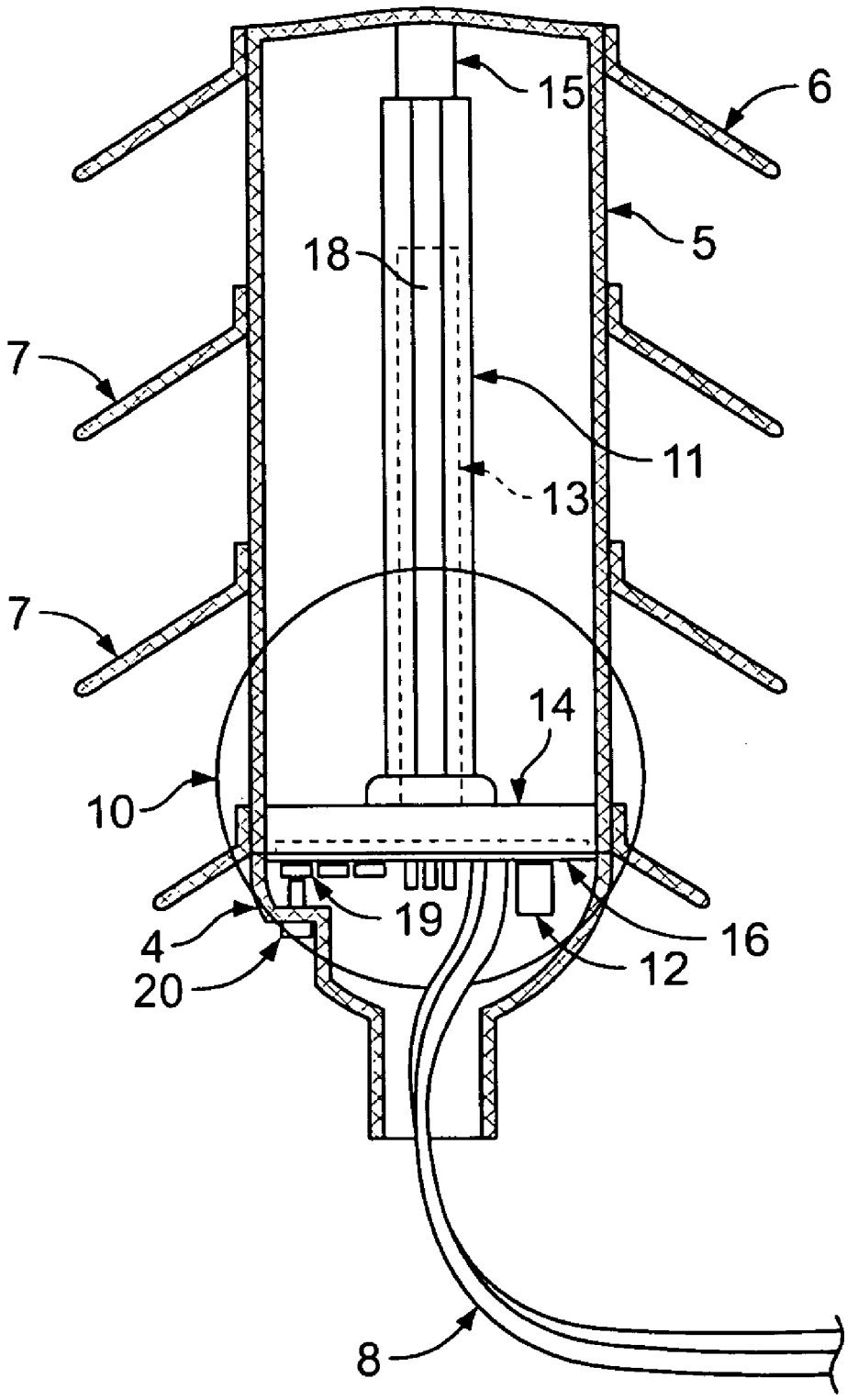
FIG. 2 is a view in partial section taken generally along line 2—2 of FIG. 1.

FIG. 1 shows the standard apparatus 9 of the present disclosure in a first preferred embodiment of its use. As shown in FIG. 2, standard apparatus 9 comprises one or more light emitting diode chips 13 mounted upon at least one elongated support member 11, support member 11 attached to an elongated heat sink 15 which provides attachment for one end of support members 11 to a cap 6, a connector 14 attached to the opposing end of support member 11, and an elongated screw 18 providing the attachment between heat sink 15 and connector 14. As is further shown in FIG. 3, a single embodiment of the present disclosure can comprise more than one support member 11. In FIG. 1 standard apparatus 9 is housed within a vertically extending pagoda-like structure comprising a base 4 configured to house electronics 12 (shown in FIG. 2), a substantially cylindrical lens 5, cap 6, and several intermediate rings 7 between cap 6 and base 4 that are evenly spaced apart from one another. The materials in the base 4, cap 6, and rings 7 are preferably plastic or metal and the material in the lens 5 is preferably plastic or glass, although each may also be made from other materials or combinations of materials. FIG. 1 further shows wires 8 entering the lower portion of base 4. Wires 8 may be of any standard AWG sufficient to carry the current necessary to power the electronics 12 and the light emitting diode chips 13 (shown in FIGS. 2–4) mounted on the support member 11 of standard apparatus 9. The light emitting diode chips 13 used in the first preferred embodiment of the present disclosure are of the type whereby each chip 13 emits light of a given color, typically red, green, or blue. A full spectrum of color is achieved via excitation of differing combinations of the light emitting diode chips 13 present. Thus, color change in the total light output of the light emitting diode chips 13 is accomplished by means of programming electronics 12 to excite selected light emitting diode chips 13. Although not limited thereto, in the present disclosure it is contemplated for such programming to be achieved through use of a momentary switch 19 that is actuated by a push button 20, or by means electronics 12 that are sensitive to switch closure, radio frequency signals, signals imposed on the drive voltage or to infrared signals. The length, width, and height dimensions of lens 5, cap 6, and rings 7 are not critical, nor is the configuration of momentary switch 19 or push button 20. Also, the configuration of base 4 is not critical as long as it provides sufficient support for lens 5 and interior space for electronics 12. Further, the shape and size of support member 11 is not critical as long as it provides the necessary space required to support the light emitting diode chips 13, and the shape and dimensions of heat sink 15 is not critical as long as it provides the necessary space and configuration necessary to accommodate support member 11.

Figure 3:
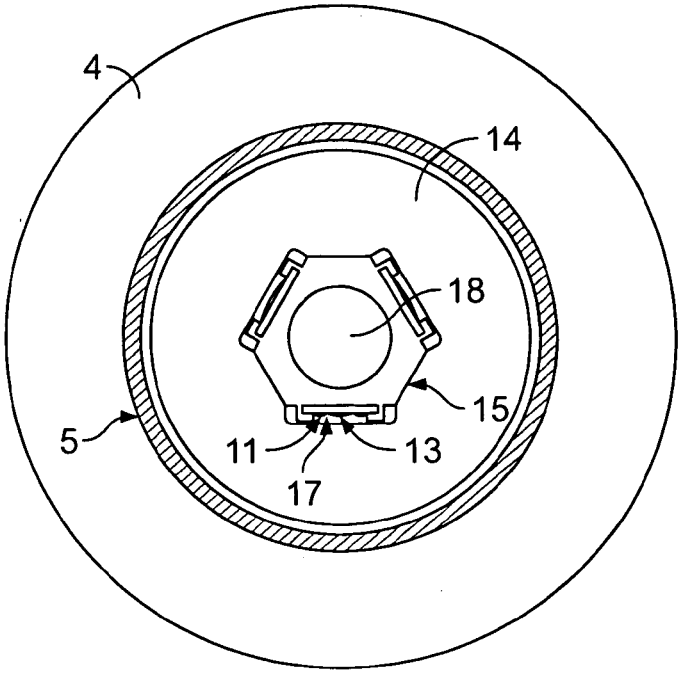
FIG. 3 is a view in partial section taken generally along line 3—3 of FIG. 1.

FIG. 2 shows the standard apparatus 9 of the first preferred embodiment of the present disclosure taken along the line 2—2 in FIG. 1, and positioning of electronics 12 and the light emitting diode chips 13 mounted on the support member 11. As is shown in FIG. 3, more than one support member 11 can be used. Support members 11 are preferably plastic or metallic, but not limited thereto, and held in place on one of its ends by a connector 14 and on its opposing end by a metallic heat sink 15, which provides heat dissipation from the light emitting diode chips 13 mounted on the support member 11. Metallic heat sink 15 and connector 14 are attached to one another by means of a screw 18, or other mechanical means (not shown). Connector 14 provides electrical connection between the light emitting diode chips 13 mounted on the support member 11 and the electronics 12 mounted on a printed circuit board 16. Wires 8 are connected between a remote power source (not shown) and the electronics 12 mounted on a printed circuit board 16. FIG. 2 also shows lens 5, cap 6, and intermediate rings 7, as well as momentary switch 19 and push button 20. The configuration of the connector 14 is not critical as long as it provides a method of electrically connecting support member 11 to the electronics 12 mounted on printed circuit board 16.

FIG. 3 shows the standard apparatus 9 of the first embodiment of the present disclosure taken along the line 3—3 in FIG. 1, and details of a top view of standard apparatus 9, whereby the light emitting diode chips 13 are shown to be mounted on three evenly spaced-apart support members 11 and are covered with a transparent protection layer 17 that protects the light emitting diode chips 13 from physical damage. Although not limited thereto, protection layer is preferably made from a transparent silicone based material. FIG. 3 also shows metallic heat sink 15 being attached to connector 14 by means of a screw 18, although other mechanical connection means (not shown) are also contemplated for such attachment. FIG. 3 further shows lens 5 surrounding support members 11, heat sink 14, and connector 14 of standard apparatus 9, and lens 5 being supported upon base 4. Although three support members 11 are shown in FIG. 3, the number used is not critical and can vary from one to twelve, or even more, depending on the intended application.

Figure 4:
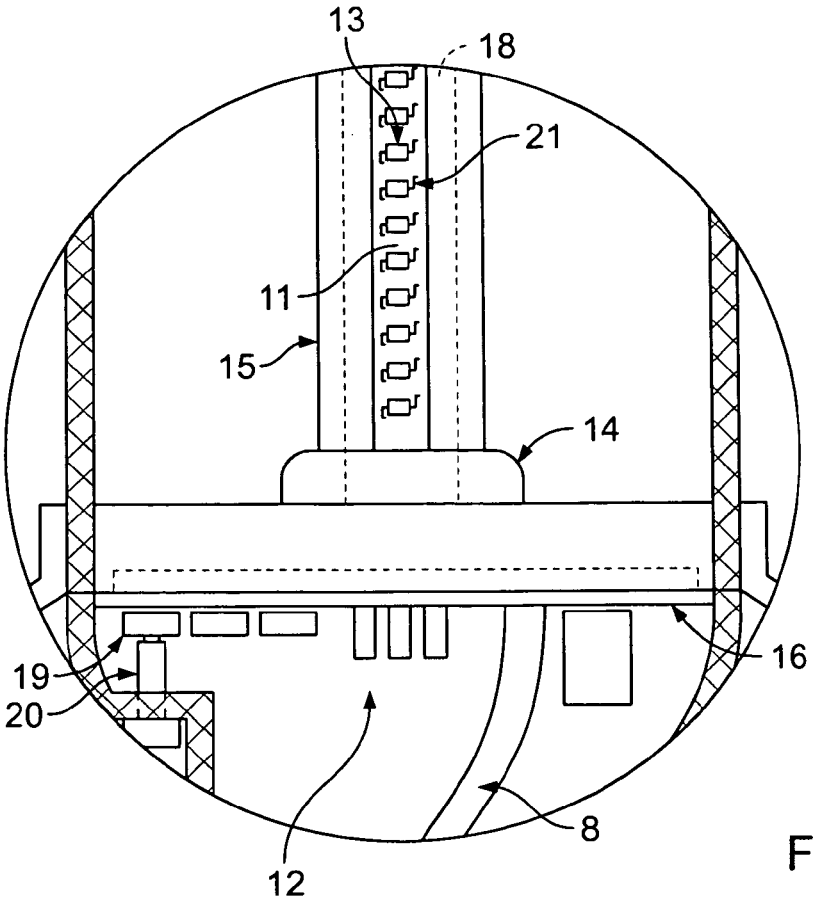
FIG. 4 is an enlarged view in partial section from circle 10 of FIG. 2.

FIG. 4 is an enlarged view of the circle 10 in FIG. 2 showing in detail standard apparatus 9 having support member 11 with multiple light emitting diode chips 13 attached thereto by means of whisker wires 21, heat sink 15, and screw 18. The number of light emitting diode chips 13 is not critical and any embodiment of the present disclosure may comprise one or more light emitting diode chips 13. As the number of light emitting diode chips 13 used increases, the intensity and spectrum of color that can be achieved is expanded. Support members 11 are held in place by the metallic heat sink 15 and screw 18 on one of its ends and connector 14 on the opposing one of its ends, with connector 14 being attached to the printed circuit board 16 holding electronics 12. FIG. 4 further shows wires 8 extending to printed circuit board 16, electronics 12 attached to printed circuit board 16, and momentary switch 19 and push button 20 connected to one another.

Figure 5:
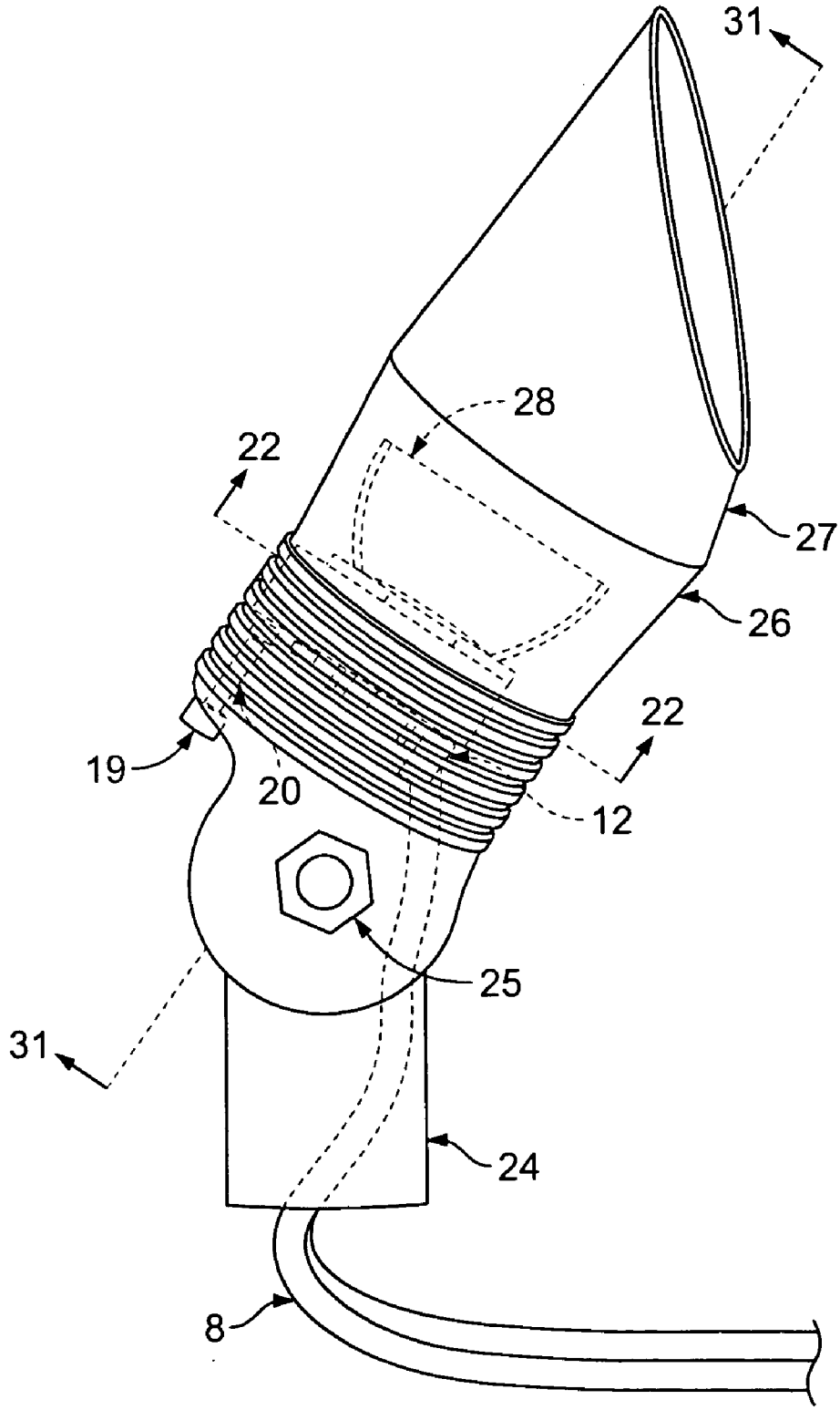
FIG. 5 is a perspective view of the present disclosure in a second possible use configuration.
Figure 6:
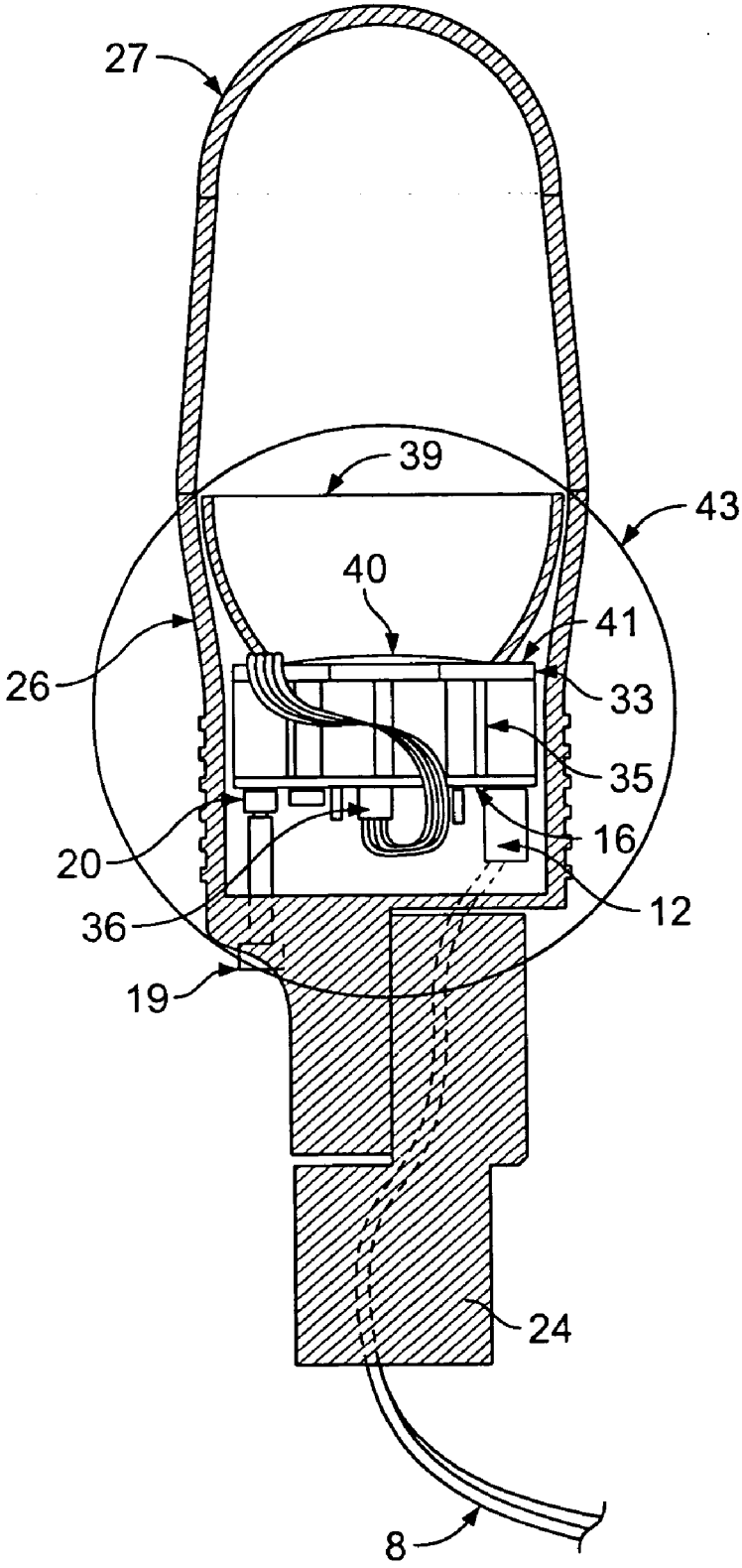
FIG. 6 is a view in partial section taken generally along line 31—31 of FIG. 5.
Figure 7:
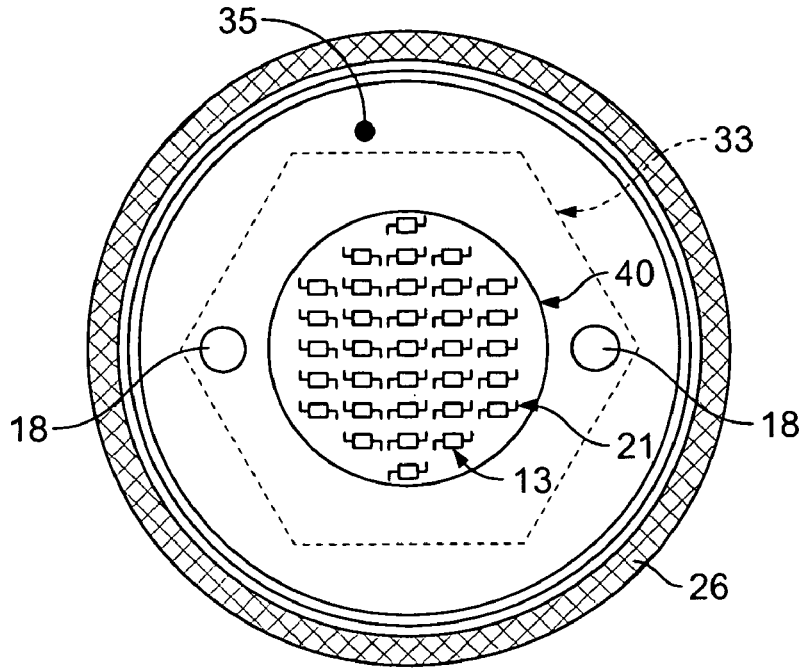
FIG. 7 is a view in partial section taken generally along line 22—22 of FIG. 5.

FIG. 5 shows the standard apparatus 28 of the present disclosure in a second preferred embodiment of its use. FIGS. 6 and 7 show standard apparatus 28 comprising reflecting or refracting lens 29, circular transparent layer 40, light emitting diode chips 13, hexagonal support member 33, and heat sink 35 attached between support member 33 and printed circuit board 16, as well as a connector and wiring harness 36 providing the electrical connection between the light emitting diode chips 13 mounted on hexagonal support member 33 and the electronics 37 mounted on printed circuit board 16. In FIG. 5 the outer structure for standard apparatus 28 is in the form of a spotlight consisting of a substantially cylindrical base support 24, a substantially tubular housing 26, an attachment and directional adjustment means 25 connected between base support 24 and tubular housing 26, and a light shield 27. The base support 24, attachment and directional adjustment means 25, tubular housing 26, and light shield 27 are preferably constructed of plastic or metal, but not limited thereto as long as the material used is at least weather-resistant. Wires 8 are shown entering the lower portion of base support 24. Wires 8 may be of any standard AWG sufficient to carry the current necessary to power the electronics 12 and the light emitting diode chips 13 (shown in FIG. 7) mounted on the hexagonal support member 33 (shown in FIGS. 6 and 7) of standard apparatus 28. Color change in the total light output of the light emitting diode chips 13 is accomplished by means of programming electronics 12, similar to that disclosed above for FIG. 1. Although not limited thereto, in the present disclosure it is contemplated for such programming to be accomplished through use of a momentary switch 19 that is actuated by a push button 20, or by means of electronics 12 (shown in FIGS. 6 and 8) that are sensitive to switch closure, radio frequency signals, signals imposed on the drive voltage, or infrared signals. The length, width, diameter, and/or height dimensions of cylindrical base support 24, attachment and directional adjustment means 25 and, light shield 27 are not critical, nor is the configuration of momentary switch 19 or push button 20. The hexagonal configuration of the support member 33, shown in FIGS. 6–8 and providing support for light emitting diode chips 13, is also not critical and may be of any suitable shape such as round, square, oblong or other as long as sufficient area is present for the attachment of light emitting diode chips 13 in sufficient quantity to produce the desired light intensity and spectrum.

FIG. 6 shows the standard apparatus 28 of the second preferred embodiment of the present disclosure taken along the line 31—31 in FIG. 5, and positioning of electronics 12 and the hexagonal support member 33 upon which light emitting diode chips 13 are mounted. The hexagonal configuration of support member 33 is not critical and other configurations such as but not limited to triangular, pentagonal, round, oval, square, and octagonal are also contemplated. Hexagonal support member 33 is preferably plastic or metal, but not limited thereto, and held in place by means of screw 18 to metallic heat sink 35, which provides heat dissipation from the light emitting diode chips 13 mounted on hexagonal support member 33. Connector and wiring harness 36 provides electrical connection between light emitting diode chips 13 mounted on hexagonal support member 33 and the electronics 12 mounted on printed circuit board 16 set in an inferior position to metallic heat sink 35. Wires 8 extend through base support 24 and the lower portion of tubular housing 26, and are connected between a remote power source (not shown) and the electronics 12 mounted on a printed circuit board 16. Refracting or reflecting lens 39 gathers the light (not shown) produced by the light emitting diode chips 13 and provides focusing as required by the application. Light shield 27 also assists in directing the light produced by the light emitting diode chips 13 according to the application. In addition, circular transparent protection layer 40 protects the light emitting diode chips 13 from moisture and other environmental contaminants. FIG. 6 also shows momentary switch 19 connected to printed circuit board 16 and push button 20 poised and ready for activation contact with momentary switch 19. The programming of electronics 12 by means of switch 19 is not critical, and such programming may also be accomplished by means of radio frequency signals, signals imposed on the drive voltage, infrared signals, and/or other local or remote programming methods (not shown).

FIG. 7 shows the standard apparatus 28 of the second preferred embodiment of the present disclosure taken along the line 22—22 in FIG. 5, and details of a top view of standard apparatus 28, with multiple light emitting diode chips 13 mounted on hexagonal support member 33. FIG. 7 further shows light emitting diode chips 13 covered with a circular transparent protection layer 40 that protects the light emitting diode chips 13 from moisture and other environmental contaminants. Although not limited thereto, protection layer 40 is preferably made from a transparent, curable liquid silicone material. The number of light emitting diode chips 13 used is not critical, and may include one or more light emitting diode chips 13, with color diversity being enhanced by use of more than one light emitting diode chip 13. FIG. 7 also shows metallic heat sink 35 being positioned within substantially tubular housing 26, and hexagonal support member 33 attached to heat sink 35 via two screws 18, although other mechanical connection means (not shown), including the use of additional screws 18, are also contemplated for such attachment. FIG. 7 further shows the light emitting diode chips 13 attached to hexagonal support member 33 via whisker wires 21.

Figure 8:
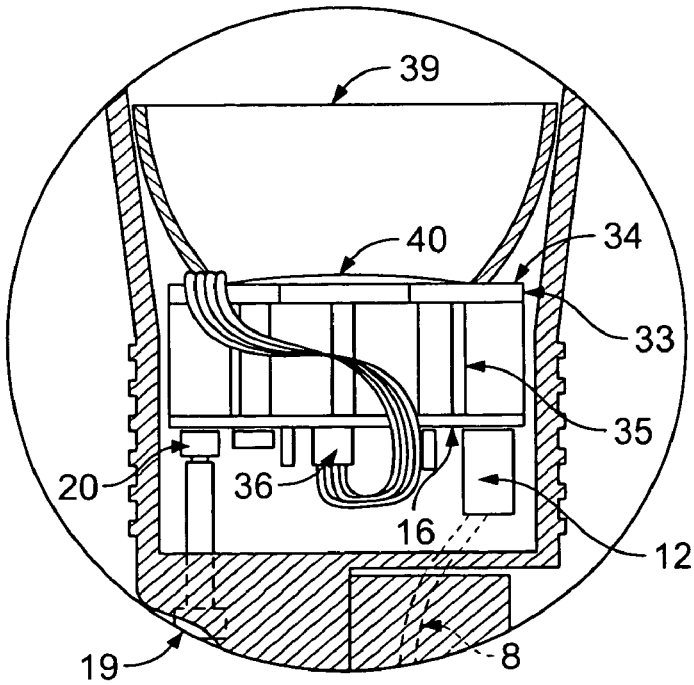
FIG. 8 is an enlarged view in partial section from circle 43 of FIG. 6.

FIG. 8 is an enlarged view of circle 43 in FIG. 6 showing in detail standard apparatus 28 having hexagonal support member 33, heat sink 35 in an inferior position to hexagonal support member 33 between support member 33 and printed circuit board 16, reflecting or refracting lens 39, circular transparent protection layer 40 positioned over the top surface of hexagonal support member 33, as well as electronics 12 mounted on printed circuit board 16 and a connector and wiring harness 36 providing the electrical connection between the light emitting diode chips 13 mounted on hexagonal support member 33 and printed circuit board 16. The number of light emitting diode chips 13 used under circular transparent protection layer 40 is not critical and any embodiment of the present disclosure may comprise one or more light emitting diode chips 13. FIG. 8 further shows wire 8 extending to electronics 12, and momentary switch 19 connected to printed circuit board 16 and push button 20 poised and ready for activation contact with momentary switch 19.

Figure 9:
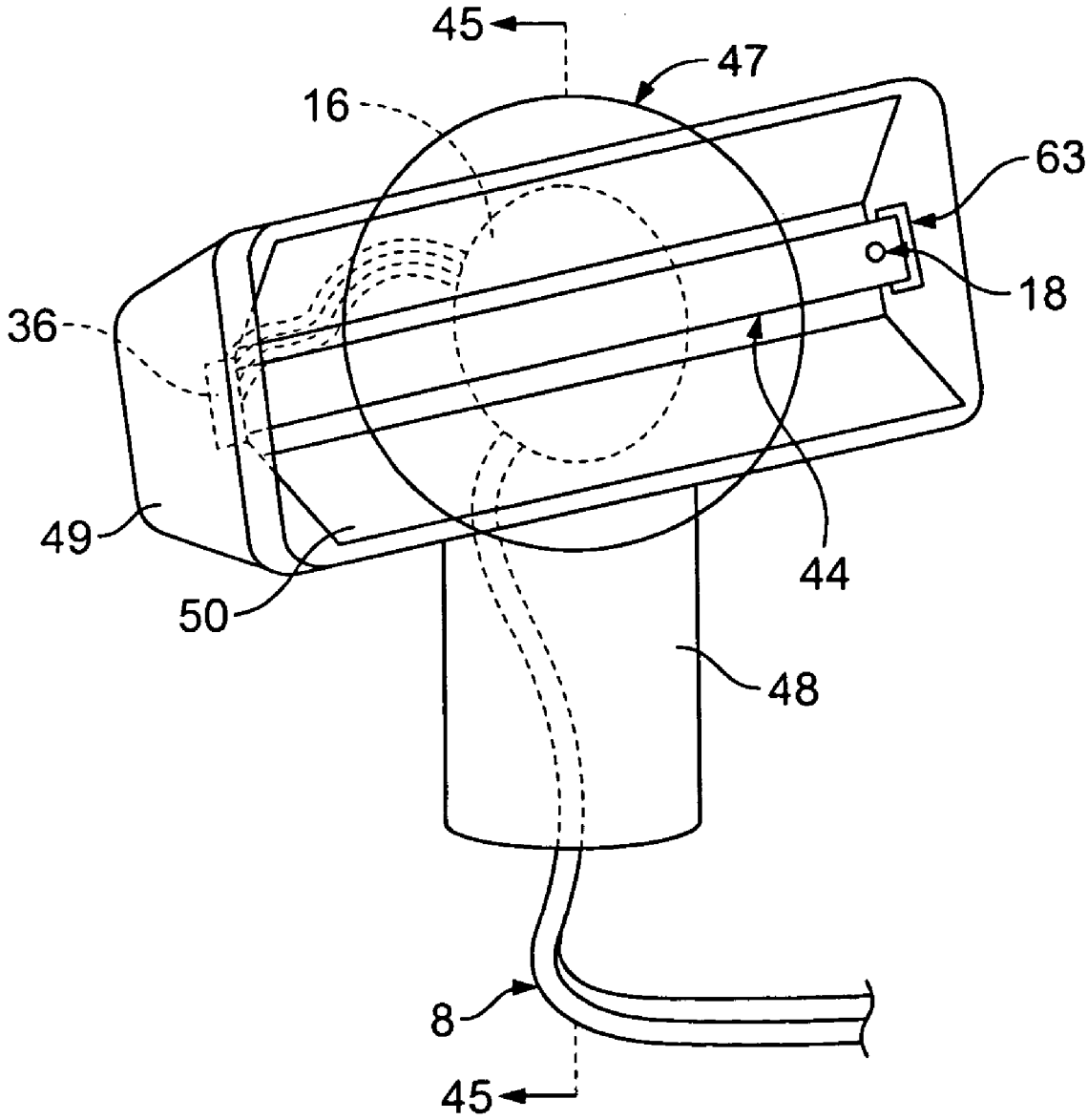
FIG. 9 is a perspective view of the present disclosure in a third possible use configuration.
Figure 10:
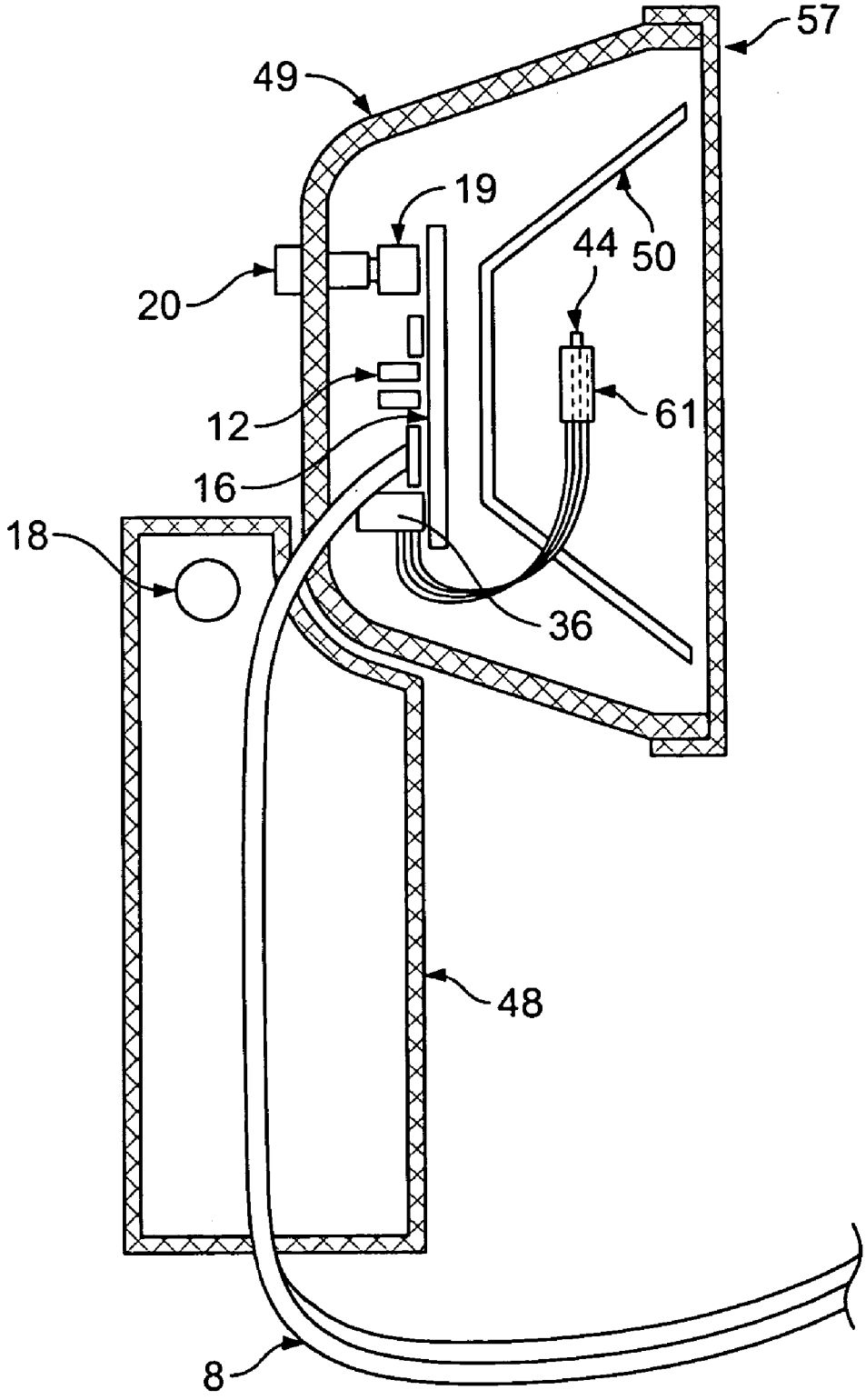
FIG. 10 is a view in partial section taken generally along line 45—45 of FIG. 9.
Figure 11:
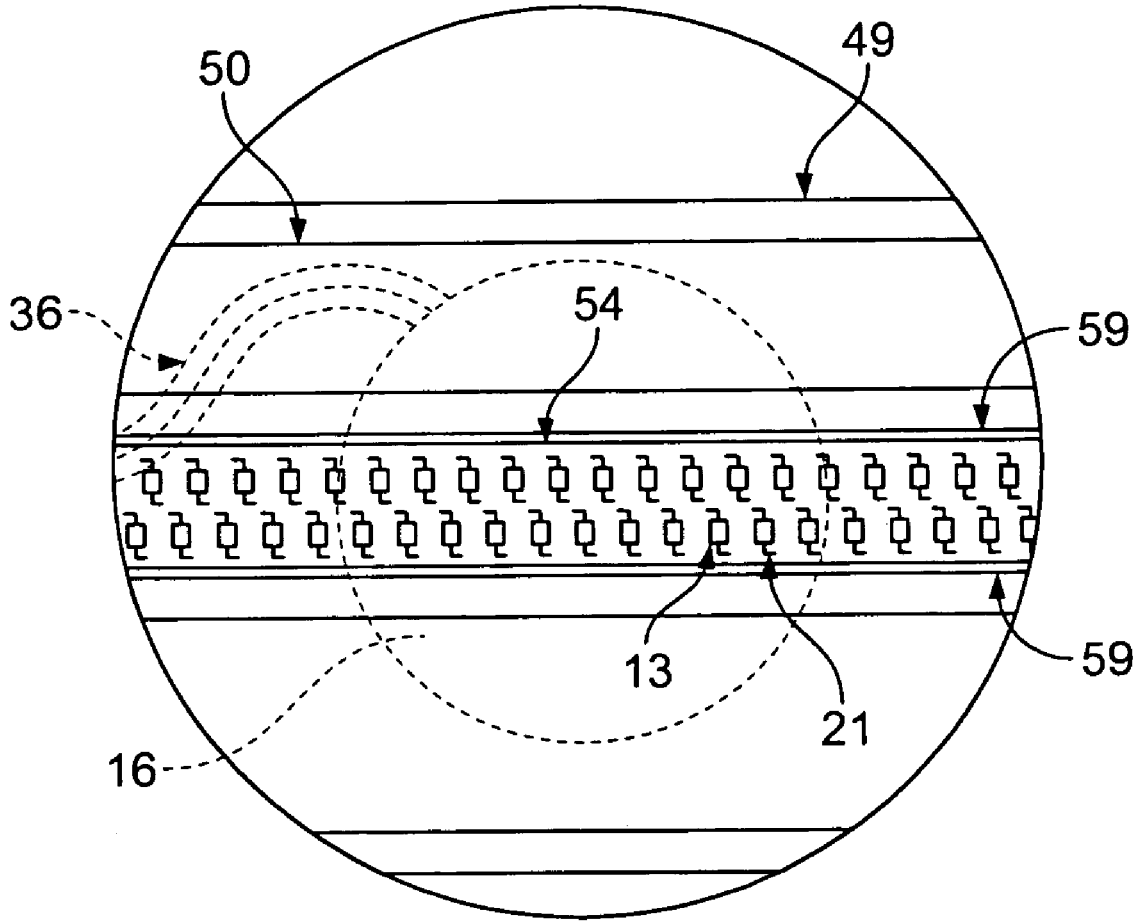
FIG. 11 is an enlarged view in partial section from circle 47 of FIG. 9.

FIG. 9 shows the standard apparatus 44 of the present disclosure in a third preferred embodiment of its use. FIGS. 10 and 11 show standard apparatus 44 comprising, an elongated substantially rectangular support member 54, light emitting diode chips 13 mounted on a substantially rectangular support member 54, and substantially rectangular support member 54 attached to elongated heat sink 59, as well as a connector and wiring harness 36 providing the electrical connection between the light emitting diode chips 13 mounted on substantially rectangular support member 54 and the electronics 12 mounted on printed circuit board 16. In FIG. 9 the outer structure for standard apparatus 44 is in the form of a floodlight consisting of a base support 48 having a substantially cylindrical lower portion, a substantially rectangular housing 49, a reflector/refractor 50, and a transparent lens 57 (shown in FIG. 10). The base support 48, substantially rectangular housing 49, and reflector/refractor 50 are preferably constructed of plastic or metal but not limited thereto and transparent lens 57 is preferably constructed of plastic or glass, but not limited thereto, as long as the materials are at a minimum weather-resistant. Wires 8 are shown entering the lower portion of base support 48. Wires 8 may be of any standard AWG sufficient to carry the current necessary to power the electronics 12 and the light emitting diode chips 13 (shown in FIG. 11) mounted on substantially rectangular support member 54 (shown in FIG. 11) of standard apparatus 44. Color changes in the total light output of the light emitting diode chips 13 are accomplished by means of programming electronics 12, similar to that disclosed above for FIG. 1. Although not limited thereto, in the present disclosure it is contemplated for such programming to be accomplished through the use of momentary switch 19 that is actuated by a push button 20 or by means of electronics 12 (shown in FIG. 10) that are sensitive to switch closure, radio frequency signals, signals imposed on the drive voltage, or infrared signals. The length, width, diameter, and/or height dimensions of base support 48, substantially rectangular housing 49, and transparent lens 57 are not critical, nor is the configuration of momentary switch 19 or push button 20. The non-energized end of standard apparatus 44 is held in place with substantially rectangular housing 49, and in front of reflector/refractor 50, by means of a mechanical fastener 63 and screw 18, although other mechanical connection means (not shown), including the use of additional screws 18, are also contemplated for such attachment. In broken lines FIG. 9 shows printed circuit board 16, as well as connector and wiring harness 36 connected between printed circuit board 16 and one end of standard apparatus 44.

FIG. 10 shows the standard apparatus 44 of the third preferred embodiment of the present disclosure taken along the line 45—45 in FIG. 9, and details of the electronics 12 attached to printed circuit board 16 and the substantially rectangular support member 54 upon which the light emitting diode chips 13 shown in FIG. 11 are mounted. The rectangular configuration of support member 54 is not critical and other configurations are also considered within the scope of the present disclosure. Substantially rectangular support member 54 is preferably plastic or metal, but not limited thereto, and although not shown in FIG. 10 or 11, support member 54 would preferably be held in place against metallic heat sink 59 (shown in FIG. 11) by means of a mechanical fastener, such as one or more screws 18, similar to the connection shown in FIG. 3 or 7. As in other embodiments, metallic heat sink 59 provides heat dissipation from the light emitting diode chips 13 mounted on substantially rectangular support member 54. Connector and wiring harness 36 provides electrical connection between the light emitting diode chips 13 mounted on substantially rectangular support member 54 and the electronics 12 mounted on a printed circuit board 16 positioned rearward from metallic heat sink 59. Wires 8 are connected between a remote power source (not shown) and the electronics 12 mounted on a printed circuit board 16. A refracting/reflecting lens 50 gathers the light (not shown) produced by the light emitting diode chips 13 and provides focusing as required by the application. A transparent lens 57 also seals the front opening in substantially rectangular housing 49, to protect light emitting diode chips 13, support member 54, refracting/reflecting lens 50, printed circuit board 16, momentary switch 19, and the electronics 12 mounted on printed circuit board 16. The substantially rectangular housing 49 can be adjusted in vertical orientation by loosening screw 18, moving substantially rectangular housing 49 into a desired angular position relative to base support 48, and then re-tightening screw 18 until substantially rectangular housing 49 is fixed relative to base support 48. FIG. 10 also shows momentary switch 19 connected to printed circuit board 16 and push button 20 poised and ready for activation contact with momentary switch 19.

FIG. 11 is an enlarged view of the circle 47 in FIG. 9 showing in detail standard apparatus 44 positioned within substantially rectangular housing 49 and having elongated substantially rectangular support member 54 in a longitudinally extending orientation relative to substantially rectangular housing 49, multiple light emitting diode chips 13 each mounted via whisker wires 21 to substantially rectangular support member 54, heat sink 59 positioned rearward from substantially rectangular support member 54, printed circuit board 16 positioned behind metallic heat sink 59, and reflector/refractor 50 positioned between printed circuit board 16 and heat sink 59, as well as a connector and wiring harness 36 providing the electrical connection to printed circuit board 16. The number of light emitting diode chips 13 held in place against substantially rectangular support member 54 is not critical and the third embodiment of the present disclosure may comprise one or more light emitting diode chips 13. FIG. 11 further shows light emitting diode chips 13 evenly spaced apart from one another, which is not critical.

In an implementation, the disclosed lamp having LEDs of red, blue and green may be switched between pre-selected colors. Table I illustrates the light emitting diode colors that may be energized to achieve a radiation of one of eight colors. As an example, to achieve a lamp that illuminates with a cyan color, an equivalent number of blue and green LEDs are energized. An orange color may be achieved by energizing red LEDs and green LEDs in a number of approximately 30% or the red LEDs. White may be achieved by illuminating an equivalent number of red, blue and green LEDs.

TABLE I

| | Color | Red Ratio | Blue Ratio | Green Ratio |
|---|---|---|---|---|
| 1. | White | 1 | 1 | 1 |
| 2. | Red | 1 | 0 | 0 |
| 3. | Orange | 1 | 0 | 0.3 |
| 4. | Yellow | 1 | 0 | 1 |
| 5. | Green | 0 | 0 | 1 |
| 6. | Cyan | 0 | 1 | 1 |
| 7. | Blue | 0 | 1 | 0 |
| 8. | Magenta | 1 | 1 | 0 |

Switching between colors is accomplished by changing the duty cycle (pulse width) of a pulse width modulator that energizes the respective colors. Binary colors (orange, yellow, cyan and magenta) are produced by setting the duty cycle of one of the primary colors (red, blue, green) colors to zero. The only time that all of the die are active is for the ternary color (white).

In an implementation, the switching may be between radiation of two colors. The two colors may be white and red or white and yellow, for example. The white light can be produced by a combination of energized LEDs as in Table I, above. Alternatively, a white LED can be used. The two colors may be selected for any reason. In some implementations, the white light may be used for landscape illumination some times during the year and the alternate color at other times of the year. For example, the alternative color may selected so as not to be visible to certain animal species. The alternate color may be used so as to lessen the attraction to that species.

The present disclosure also may be used to mitigate the variability in the peak wavelength of light radiated by an energized LED. The manufacturing process of high brightness LEDs can lead to relatively large variations in emission wavelength and power levels for devices. While it is possible to purchase LEDs with tight specifications on wavelength and power level, tight specifications lead to higher unit costs for the LEDs. When binary and ternary colors are desired, these variations can result in shifts in the perceived colors of the binary and ternary colors. This is most evident for white colors where the human eye is particularly sensitive to small changes in hue. Small differences in the emission wavelength or power levels of LEDs can make the difference between seeing light that is a pure white, pink, yellow, green, blue, purple or tinted some other color.

Control over the duty cycle of pulses applied to the LEDs in the present disclosure may enable the use of LEDs having wider wavelength and power specification variation than tight tolerance LEDs and still obtain a consistent white light as well as binary and ternary colors. This may be accomplished by adjusting the duty cycle for each color LED. Adjustment of the duty cycle can result in a perceived change in brightness as seen by the human eye. Thus, a change in wavelength output of an LED that results in a tinting of the white light may be overcome by adjusting the duty cycle of the energizing pulses to the LED. Once these parameters are set, binary and ternary colors can be obtained by adjusting the output according to the ratios given in Table I above. These adjustments can be made by measuring the chromaticity coordinates of the device while it is set to "white" light. If the light is in fact white, then no adjustment is necessary. If the light is reddish, then the duty cycle of the red is decreased until the light is white. If the light is bluish, then the duty cycle for the blue is decreased until the light appears white, etc.

Figure 12:
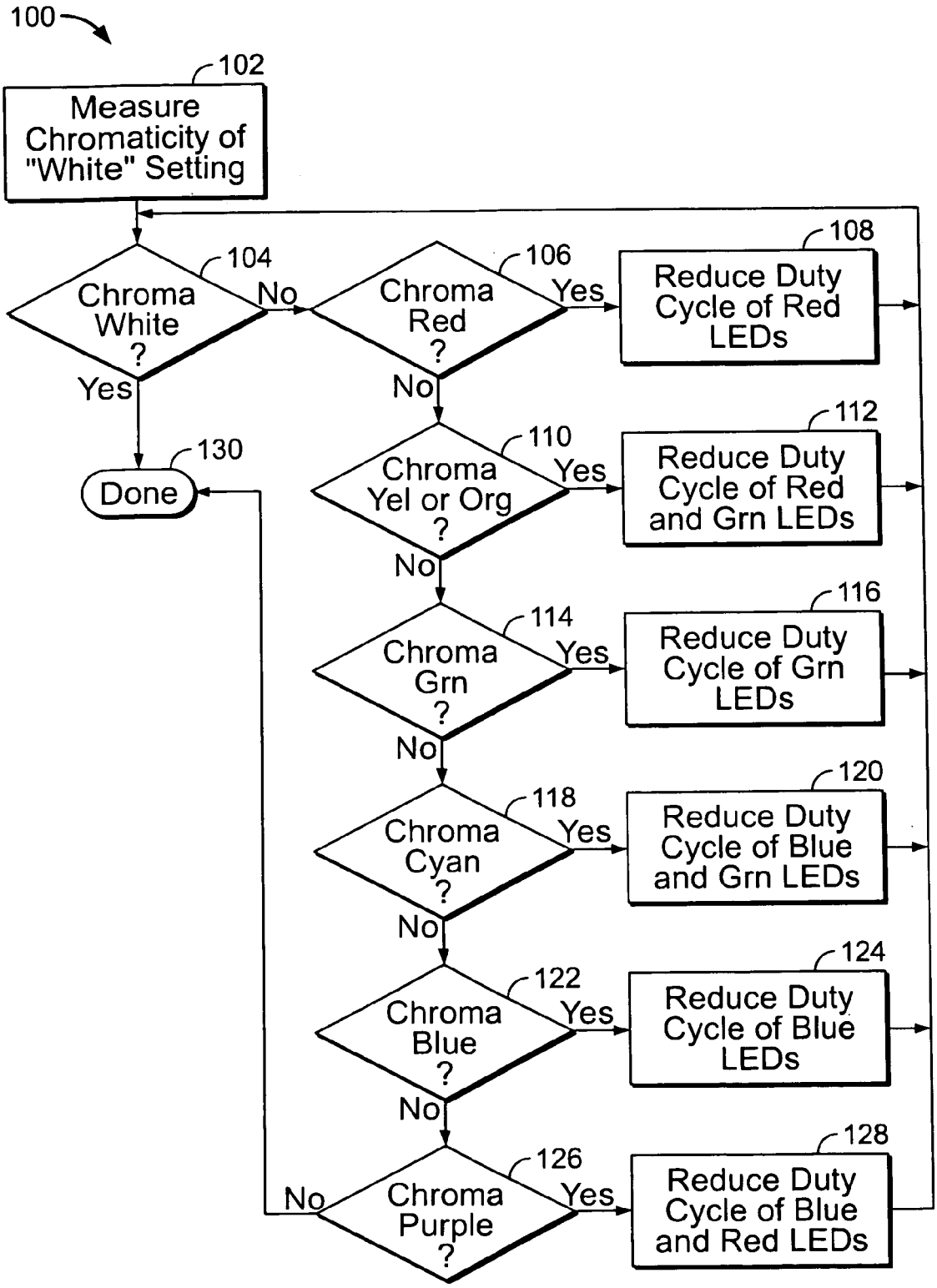
FIG. 12 flow chart for adjusting the chromaticity of light output.

FIG. 12 is a flow diagram 100 for adjusting the color of light radiated by the lamp of the present disclosure by adjusting the duty cycle of the pulses used to energize the LEDs. The lamp is energized to radiate a white light. The chromaticity of the white light is measured 102 using any standard method including a spectrograph or the human eye. If the chromaticity is found to be white, then the lamp is satisfactorily set and the method ends 130. If the chromaticity of the white light is found to be red 106, then the duty cycle of the pulses energizing the red LEDs is reduced 108 and the chromaticity of the white light is again measured 104. If the chromaticity of the white light is found to be yellow (or orange) 110 then the duty cycle of the pulses energizing the red and green LEDs is reduced 112 and the chromaticity of the white light is again measured 104. If the chromaticity of the white light is found to be green 114, then the duty cycle of the pulses energizing the red LEDs is reduced 116 and the chromaticity of the white light is again measured 104. If the chromaticity of the white light is found to be cyan 118, then the duty cycle of the pulses energizing the blue and green LEDs is reduced 120 and the chromaticity of the white light is again measured 104. If the chromaticity of the white light is found to be blue 122, then the duty cycle of the pulses energizing the blue LEDs is reduced 124 and the chromaticity of the white light is again measured 104. If the chromaticity of the white light is found to be purple 126, then the duty cycle of the pulses energizing the blue and red LEDs is reduced 128 and the method is done 130.

Other implementations are within the scope of the following claims.

What is claimed is:

1. An electronically controlled, color changeable, multiple light emitting diode chip landscape lighting system, comprising:

landscape lighting housing means;

support member means disposed within said housing means and adapted for surface mounting of electrically interconnected light emitting diode chips;

a plurality of light emitting diode chips;

mounting means for attaching said light emitting diode chips to said support member;

connector assembly means adapted for mechanical and electrical support of said support member means;

electronic control means adapted for voltage control in said light emitting diode chips sufficient to cause color change of illumination emitted by said light emitting diode chips;

a transparent layer fixed to the support member, said transparent layer within said landscape lighting housing means in a position to cover said light emitting diode chips, wherein said light emitting diode chips are between said support member and said transparent layer, with said support member and said transparent layer being substantially parallel to one another; and activation means adapted for engaging said electronic control means so that when said system is electrically connected to a source of electrical power, said electronic control means via said connector assembly means is able to cause said light emitting diodes to become excited and emit colored light, the color of light emitted being a function of the voltage provided by said electronic control means.

2. The lighting system according to claim 1, further comprising a heat sink means within said landscape lighting housing means adapted for assisting in the dissipation of heat generated by said light emitting diode chips.

3. The lighting system according to claim 2, further comprising at least one elongated screw, and wherein said heat sink means and said connector assembly means are connected to said support member means using each said elongated screw.

4. The lighting system according to claim 1, wherein said electronic control means comprises a printed circuit assembly.

5. The lighting system according to claim 4, wherein said printed circuit assembly is made an integral part of said connector assembly means.

6. The lighting system according to claim 4, further comprising a plurality of voltage altering components configured for use with said printed circuit assembly whereby exchange of said voltage altering components will cause a change in the direct current voltage supply sent from said printed circuit assembly to said light emitting diodes and cause said light emitting diodes to emit different colors of light for a variable spectrum output.

7. The lighting system according to claim 4, further comprising an electronic circuit assembly configured for control of said printed circuit assembly.

8. The lighting system according to claim 7, wherein said electronic circuit assembly is sensitive to signals selected from a group consisting of logic flows, radio frequency signals, infrared signals, and commands propagated as signals impressed on the alternating current voltage source.

9. The lighting system according to claim 1, wherein said activation means is selected from a group consisting of logic flows, local switching, radio frequency control, infrared control, signals imposed over line voltage, and a momentary switch activated by a push button.

10. The lighting system according to claim 1, wherein said support member means is selected from a group consisting of single support members and multiple support members.

11. The lighting system according to claim 10, wherein said connector assembly means provides electrical interconnection between said multiple support members so that excitation voltage and current from said printed circuit assembly is able to reach each one of said support members.

12. The lighting system according to claim 1, wherein said mounting means further comprises electrical connection means adapted for electrically interconnecting said light emitting diode chips.

13. The lighting system according to claim 12, wherein electrical connection means comprises a plurality of whisker wires.

14. The lighting system according to claim 1, further comprising an optical system for viewing illumination from said light emitting diode chips.

15. The lighting system according to claim 14, wherein said optical system is selected from a group consisting of reflected optical systems and refracted optical systems.

16. The lighting system according to claim 1 wherein said landscape lighting housing means is selected from a group consisting of pagoda shaped landscape lighting fixtures, spotlight landscape lighting fixtures, flood light landscape lighting fixtures, well light landscape lighting fixtures, coach light landscape lighting fixtures, carnage light landscape lighting fixtures, and landscape lighting fixtures having a light shield.

17. A method for electronically controlling color change in landscape lighting systems, said method comprising the steps of:

providing at least one housing configured for landscape lighting use, at least one support member, a plurality of light emitting diode chips, a transparent layer, mounting means, connector assembly means, electronic control means, activation means, and an electrical source of power;

positioning said support member within said housing;

surface mounting said light emitting diode chips on each said support member using said mounting means;

fixing said transparent layer to said support member so as to cover said plurality of light emitting diode chips such that said light emitting diode chips are between said support member and said transparent layer, with said support member and said transparent layer being substantially parallel to one another;

connecting said connector assembly means to said support member so as to provide both mechanical and electrical support of said support member;

connecting said electronic control means to said light emitting diode chips so as to provide voltage control thereof sufficient to cause color change of illumination emitted by said light emitting diode chips;

engaging said activation means with said electronic control means; and electrically connecting said electronic control means to said source of electrical power, so that said electronic control means via said connector assembly means is able to cause said light emitting diodes to become excited and emit colored light, the color of light emitted being a function of the voltage provided by said electronic control means.

18. A lighting system comprising:

a housing having a lens for diffusing light;

a plurality of light emitting diode light sources mounted in the housing;

a transparent protection layer fixed to a support member in the housing and adapted to cover said plurality of light emitting diode light sources, wherein the support member is adapted for surface mounting of the light emitting diode light sources and further wherein said plurality of light emitting diode light sources are between said support member and said transparent protection layer, with said support member and said transparent layer being substantially parallel to one another;

an electronic controller coupled to the diode light sources and adapted such that when operating controls the voltage to the diode light sources sufficient to cause a color change of light emitted by the diode light sources; and an activator coupled to the electronic controller to cause the electronic controller to energize the diode light sources.

19. The lighting system of claim 18 wherein the light emitting diode light sources comprise the colors red, blue and green.

20. The lighting system of claim 18 wherein the activator comprises one of logic flows, local switching, radio frequency control, infrared control, signals imposed over line voltage, and a momentary switch activated by a push button.

21. The lighting system of claim 20 wherein the activator comprises a switch.

22. The lighting system of claim 21 wherein the activator is arranged to cause the lamp to radiate any one of eight colors.

23. The lighting system of claim 18 wherein the light emitting diode light sources comprise the colors white and red.

24. The lighting system of claim 23 wherein the activator is a switch arranged to cause the lamp to energize either the white light emitting diodes or the red light emitting diodes.

25. The lighting system of claim 20 wherein the activator is a switch arranged to cause the lamp to either energize light emitting diodes that cause the lamp to radiate a white light or to energize the red light emitting diodes.

26. The lighting system of claim 18 further comprising:

measuring the chromaticity of a light radiated from the lighting system when all of the light emitting diode light sources are energized; and adjusting a duty cycle of pulses energizing the light emitting diode light sources to alter the chromaticity of the light radiated from the lighting system.

* * * * *